US010249241B2

(12) United States Patent
Lin

(10) Patent No.: US 10,249,241 B2
(45) Date of Patent: Apr. 2, 2019

(54) METHOD AND DEVICE OF DRIVING DISPLAY AND DISPLAY DEVICE USING THE SAME

(71) Applicant: EverDisplay Optronics (Shanghai) Limited, Shanghai (CN)

(72) Inventor: Ren-Hung Lin, Shanghai (CN)

(73) Assignee: EverDisplay Optronics (Shanghai) Limited, Shanghai (CN)

( * ) Notice: Subject to any disclaimer, the term of this patent is extended or adjusted under 35 U.S.C. 154(b) by 83 days.

(21) Appl. No.: 15/362,934

(22) Filed: Nov. 29, 2016

(65) Prior Publication Data

US 2017/0287400 A1 Oct. 5, 2017

(30) Foreign Application Priority Data

Mar. 31, 2016 (CN) ..... 2016 1 0195854

(51) Int. Cl.
*G09G 3/3258* (2016.01)
*G09G 3/36* (2006.01)
(Continued)

(52) U.S. Cl.
CPC ..... *G09G 3/3258* (2013.01); *G09G 3/3648* (2013.01); *G09G 5/04* (2013.01); *G09G 5/377* (2013.01); *G09G 2310/08* (2013.01); *G09G 2320/0242* (2013.01); *G09G 2360/16* (2013.01)

(58) Field of Classification Search
CPC ..... G09G 3/3258; G09G 3/3648; G09G 5/04; G09G 5/377; G09G 2310/08;
(Continued)

(56) References Cited

U.S. PATENT DOCUMENTS 8,917,266 B2 * 12/2014 Park ..... G09G 3/2096 326/93
2002/0033813 A1 * 3/2002 Matsumura ..... G09G 3/3611 345/204
(Continued)

FOREIGN PATENT DOCUMENTS

KR 20070082765 A 8/2007
KR 20070122097 A 12/2007
(Continued)

OTHER PUBLICATIONS

The Notice of Allowance issued in the counterpart Korean application No. 10-2016-0073838 dated Feb. 19, 2018 by the KIPO.
(Continued)

*Primary Examiner* — Tom V Sheng
(74) *Attorney, Agent, or Firm* — Yunling Ren

(57) ABSTRACT

The present disclosure provides a method and a device of driving a display and a display device. The method includes: conducting first image data combined with image data relevant to the first image data in time/space by a micro disturbance operation processing, to obtain second image data; and outputting the second image data. By changing the conventional driving mechanism, conducting the first image data combined with relevant image data with respect to a time axis by an operation processing, for example, adding a time axis correction parameter which may be dynamically adjusted and conducting a micro disturbance operation, so as to determine color gray scales of respective sub-pixels on the display according to an adjusted driving circuit, which may make colors of image data on the display more plentiful and optimize display effect.

7 Claims, 9 Drawing Sheets

(51) Int. Cl.
*G09G 5/04* (2006.01)
*G09G 5/377* (2006.01)

(58) Field of Classification Search
CPC ... G09G 2320/0209; G09G 2320/0242; G09G 2320/0257; G09G 2320/10; G09G 2320/103; G09G 2320/106; G09G 2340/16; G09G 2360/16; G06T 2207/20182; G06T 2207/20201; G06T 2207/20212; G06T 2207/20216; G06T 2207/20221; G06T 2207/20224
See application file for complete search history.

(56) References Cited

U.S. PATENT DOCUMENTS

2004/0196234 A1* 10/2004 Shiomi ..... G09G 3/3648 345/89
2007/0195046 A1* 8/2007 Cho ..... G09G 3/3648 345/98
2007/0279574 A1* 12/2007 Minamizaki ..... G09G 3/3648 349/192
2007/0285349 A1* 12/2007 Hong ..... G09G 3/3406 345/38
2009/0085896 A1* 4/2009 Nagase ..... H04N 19/147 345/204
2010/0007597 A1* 1/2010 Lee ..... G09G 3/3648 345/99
2010/0007648 A1* 1/2010 Nam ..... G09G 3/3611 345/213
2010/0156949 A1* 6/2010 Park ..... G09G 3/3607 345/690
2011/0234773 A1* 9/2011 Koh ..... G09G 3/003 348/56
2011/0279466 A1* 11/2011 Park ..... G09G 3/3648 345/581
2012/0256904 A1* 10/2012 Jung ..... G09G 3/36 345/419
2014/0092081 A1* 4/2014 Liao ..... G09G 3/3696 345/213
2014/0118399 A1* 5/2014 Todorovich ..... G06T 3/4038 345/634
2014/0125685 A1* 5/2014 Yeh ..... G09G 5/393 345/545
2014/0232756 A1* 8/2014 Choi ..... G09G 3/36 345/690

FOREIGN PATENT DOCUMENTS

KR 20100037892 A 4/2010
KR 10-2010-0131897 A 12/2011
KR 20120114812 A 10/2012
KR 20130101324 A 9/2013

OTHER PUBLICATIONS

The 1st office action issued in the counterpart KR application No. 10-2016-0073838 dated Aug. 17, 2017 by the KIPO.

* cited by examiner

METHOD AND DEVICE OF DRIVING DISPLAY AND DISPLAY DEVICE USING THE SAME

CROSS-REFERENCE TO RELATED APPLICATIONS

This application is based upon and claims priority to Chinese Patent Application No. 201610195854.9, filed on Mar. 31, 2016, the entire contents thereof are incorporated herein by reference.

TECHNICAL FIELD

The present disclosure relates to the field of display technology, particularly to a method of driving a display, a device of driving a display and a display device using the device.

BACKGROUND

For most displays, whether it is a conventional LCD (Liquid Crystal Display) or a new type AMOLED (Active Matrix/Organic Light Emitting Diode), a color gray scale that it displays is only determined by provided signal driving voltages.

FIG. 1 shows a principle diagram of an existing driving mechanism of displays. First image data is provided to a drive circuit 01, and the drive circuit 01 outputs a driving voltage corresponding to the first image data to the display 02. Specifically, the drive circuit 01 includes a digital to analog converter (i.e., D/A converter) 03. Assuming that RGB data is provided to the D/A converter 03, after a digital to analog conversion in the D/A converter 03, i.e. after a multi-channel decoding conversion, a definite driving voltage is obtained. The converted driving voltage is provided to the display 02. The display 02 in turn determines the luminous brightness and color gray scale of the display according to the definite driving voltage in the display process.

From the foregoing, it can be seen that the existing driving circuit directly generates a corresponding drive voltage according to the first image data, color performance on the display may only be directly reflected on the display according to the first image data. Richness of color display may only depend on the display effect of the display, without any other optimization mechanism. Therefore, it needs to provide a novel driving mechanism, to let displays have more plentiful colors.

The above information disclosed in this Background section is only for enhancing understanding of the background of the present disclosure, therefore, it may include information that does not constitute prior art known by those skilled in the art.

SUMMARY

Aiming at defects existing in the prior art, the present disclosure provides a method of driving a display, a device of driving a display and a display device using the device, so as to solve, at least, in part, the technical problem that, in the driving mechanism in the prior art, richness of color display only depends on display effect of the display, which makes colors of the display not plentiful enough.

The other characteristics and advantages of the present disclosure will become apparent from the following description, or in part, may be learned by the practice of the present disclosure.

According to an aspect of the present disclosure, there is provided a method of driving a display, including:

conducting first image data combined with image data relevant to the first image data in time/space by a micro disturbance operation processing, to obtain second image data; and outputting the second image data.

According to one implementation of the present disclosure, the method further includes:

conducting a circuit converting on the first image data or the second image data, to obtain a corresponding driving voltage.

According to another implementation of the present disclosure, the image data relevant to the first image data in time/space is image data of two frames preceding the first image data.

According to another implementation of the present disclosure, the conducting first image data combined with image data relevant to the first image data in time/space by a micro disturbance operation processing includes:

according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, calculating a first time axis correction parameter;

according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, calculating a second time axis correction parameter; and according to the first image data combined with the first time axis correction parameter and the second time axis correction parameter, calculating and obtaining the second image data, wherein the image data of the $x^{th}$ sub-pixel in the $y^{th}$ scanning line of the $n^{th}$ frame image is the first image data.

According to another implementation of the present disclosure, a formula for calculating the first time axis correction parameter is:

$$\delta_1(R)=(R_{n-1}(x,y)-R_{n-2}(x,y))/R_{n-2}(x,y),$$

a formula for calculating the second time axis correction parameter is:

$$\delta_2(R)=(R_n(x,y)-R_{n-1}(x,y))/R_{n-1}(x,y), \text{ and}$$

a formula for calculating the second image data is:

$$R_n'(x,y)=R_n(x,y)+\omega_{n-2}*\delta_1(R)+\omega_{n-1}*\delta_2(R),$$

wherein $\delta_1(R)$ is the first time axis correction parameter of the $x^{th}$ sub-pixel in the $y^{th}$ scanning line of the $n^{th}$ frame image, $\delta_2(R)$ is the second time axis correction parameter of the $x^{th}$ sub-pixel in the $y^{th}$ scanning line of the $n^{th}$ frame image, $R_n(x, y)$ is the image data of the $x^{th}$ sub-pixel in the $y^{th}$ scanning line of the $n^{th}$ frame image, $R_{n-1}(x, y)$ is the image data of the $x^{th}$ sub-pixel in the $y^{th}$ scanning line of the $(n-1)^{th}$ frame image, $R_{n-2}(x, y)$ is the image data of the $x^{th}$ sub-pixel in the $y^{th}$ scanning line of the $(n-2)^{th}$ frame image, $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1.

According to another aspect of the present disclosure, there is provided a device of driving a display, including:

an operation circuit, configured to, conduct first image data combined with image data relevant to the first image data in time/space by a micro disturbance operation processing, to obtain second image data; and an outputting circuit, configured to output the second image data.

According to another implementation of the present disclosure, the device further includes:

a converting circuit, configured to conduct a circuit converting on the first image data or the second image data, to obtain a corresponding driving voltage.

According to another implementation of the present disclosure, the image data relevant to the first image data in time/space is image data of two frames preceding the first image data.

According to another implementation of the present disclosure, the operation circuit includes:

a first calculating sub-circuit, configured to, according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, calculate a first time axis correction parameter;

a second calculating sub-circuit, configured to, according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, calculate a second time axis correction parameter; and a third calculating sub-circuit, configured to, according to the first image data combined with the first time axis correction parameter and the second time axis correction parameter, calculate and obtain the second image data, wherein the image data of the $x^{th}$ sub-pixel in the $y^{th}$ scanning line of the $n^{th}$ frame image is the first image data.

According to another implementation of the present disclosure, a formula by which the first calculating sub-circuit calculates the first time axis correction parameter is:

$$\delta_1(R)=(R_{n-1}(x,y)-R_{n-2}(x,y))/R_{n-2}(x,y),$$

a formula by which the second calculating sub-circuit calculates the second time axis correction parameter is:

$$\delta_2(R)=(R_n(x,y)-R_{n-1}(x,y))/R_{n-1}(x,y), \text{ and}$$

a formula by which the third calculating sub-circuit calculates the second image data is:

$$R_n'(x,y)=R_n(x,y)+\omega_{n-2}*\delta_1(F)+\omega_{n-1}*\delta_2(R),$$

wherein $\delta_1(R)$ is the first time axis correction parameter of the $x^{th}$ sub-pixel in the $y^{th}$ scanning line of the $n^{th}$ frame image, $\delta_2(R)$ is the second time axis correction parameter of the $x^{th}$ sub-pixel in the $y^{th}$ scanning line of the $n^{th}$ frame image, $R_n(x, y)$ is the image data of the $x^{th}$ sub-pixel in the $y^{th}$ scanning line of the $n^{th}$ frame image, $R_{n-1}(x, y)$ is the image data of the $x^{th}$ sub-pixel in the $y^{th}$ scanning line of the $(n-1)^{th}$ frame image, $R_{n-2}(x, y)$ is the image data of the $x^{th}$ sub-pixel in the $y^{th}$ scanning line of the $(n-2)^{th}$ frame image, $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1.

According to a further aspect of the present disclosure, there is provided a display device, including a display and the above device of driving the display according to the second aspect.

Based on above technical solution, advantageous effects of the present disclosure lie in that: by changing the conventional driving mechanism, adding the time axis correction parameter which may be dynamically adjusted with respect to the time axis to the first image data and conducting the micro disturbance operation, so as to determine color gray scales of respective sub-pixels on the display according to the adjusted driving circuit, which may make colors of image data on the display more plentiful and optimize display effect.

BRIEF DESCRIPTION OF THE DRAWINGS

The exemplary implementations thereof will be described in detail by referring to the accompanying drawings, through which the above and other features and advantages of the disclosure will become more apparent.

DETAILED DESCRIPTION

Figure 1:
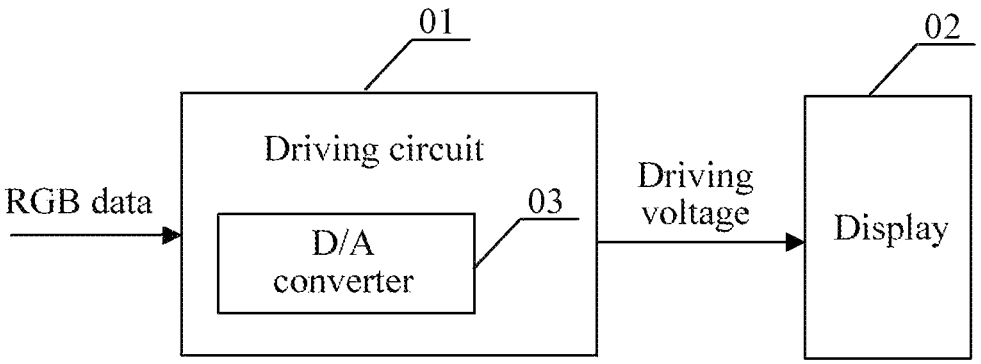
Fig.1 (Prior Art)
FIG. 1 is a principle diagram of an existing driving mechanism of displays.

The exemplary implementations of the present disclosure will now be described more fully by referring to the accompanying drawings. However, the exemplary implementations can be implemented in various forms and shall not be understood as being limited to the implementations set forth herein; instead, these implementations are provided so that this disclosure will be thorough and complete, and the conception of exemplary implementations will be fully conveyed to those skilled in the art. In the drawings, the same reference signs denote the same or similar structures, thus their detailed description will be omitted.

In addition, the described features, structures or characteristics may be combined in one or more embodiments in any suitable manner. In the following description, numerous specific details are provided so as to allow a full understanding of the embodiments of the present disclosure. However, those skilled in the art will recognize that the technical solutions of the present disclosure may be practiced without one or more of the specific details; or other methods, components, materials and so on may be used. In other cases, well-known structures, materials or operations are not shown or described in detail to avoid obscuring various aspects of the present disclosure.

The displayed color gray scale in the prior art is only determined by a provided signal driving voltage, thus display effects of colors needs to be optimized. A display effect of the display shall be relevant to content of image data itself, besides a definite driving voltage output by a driving circuit. Thus, if the content of image data may be combined with the driving voltage mechanism, i.e., if the driving voltage mechanism may be dynamically adjusted according to the content of the image data, the display effect of the display may have the maximum display elasticity and more optimized image visual effect.

Figure 2:
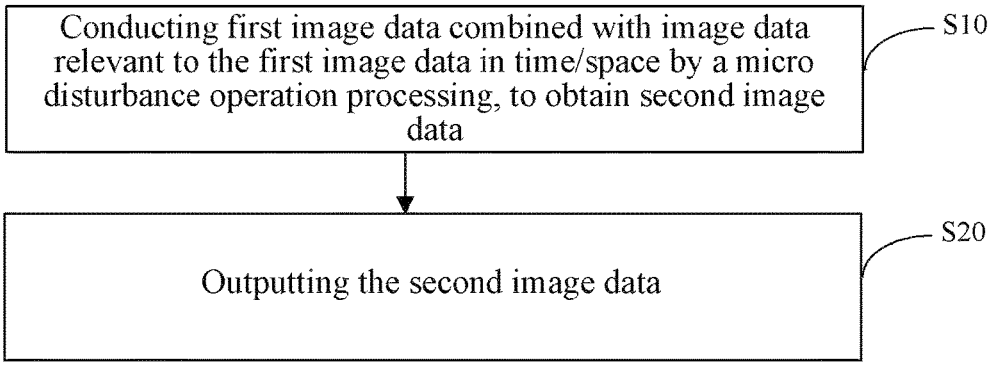
FIG. 2 is a flow chart of steps of a method of driving a display provided according to an embodiment of the present disclosure.

FIG. 2 is a flow chart of steps of a method of driving a display provided according to the present embodiment. It is an optimization mechanism of driving the display. The method may be applied to LCD displays or AMOLED or the like, in which the color gray scale is determined by driving voltage.

As shown in FIG. 2, in step S10, first image data combined with image data relevant to the first image data in time/space is conducted by a micro disturbance operation processing, to obtain second image data. Thus, the second image data is image data obtained by conducting the micro disturbance operation processing on the first image data. For common red, green and blue display, the first image data is RGB data, and the second image data is processed RGB data, represented by R'G'B' data.

As shown in FIG. 2, in step S20, the second image data is output.

It shall be noted that, the method further includes converting the image data into a corresponding driving voltage, preceding or after conducting the first image data combined with the relevant image data by the micro disturbance operation processing in S10. For example, preceding step S10, i.e., in step S10', a circuit converting may be conducted on the first image data to obtain a driving voltage corresponding to the first image data, and disturbance parameters that need to be added during the generation of the second image data are calculated, such that data of each sub-pixel in the second image data may be converted into an output voltage through a decoding circuit after the second image data is generated. Alternatively, after step S20, i.e. in step S10", a circuit converting is conducted on the second image data to obtain a driving voltage corresponding to the second image data.

In the present embodiment, "relevant image data" may be image data which has a precedence relationship with the first image data in time. If image data of a sub-pixel of a current frame is the first image data, the relevant image data may be image data which has relevance to the current frame with respect to a time axis, for example, image data of a previous one frame or even previous several frames, or a next one frame or even next several frames. In the present embodiment, image data of two frames preceding the first image data is taken as an example of the relevant image data.

Figure 3:
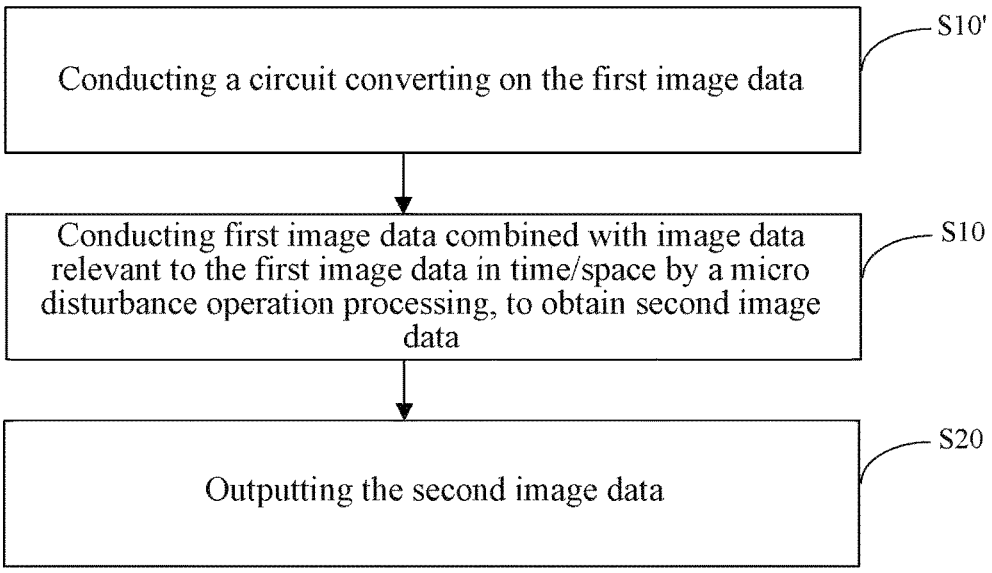
FIG. 3 is a flow chart of an implementation of a method provided according to an embodiment of the present disclosure.
Figure 4:
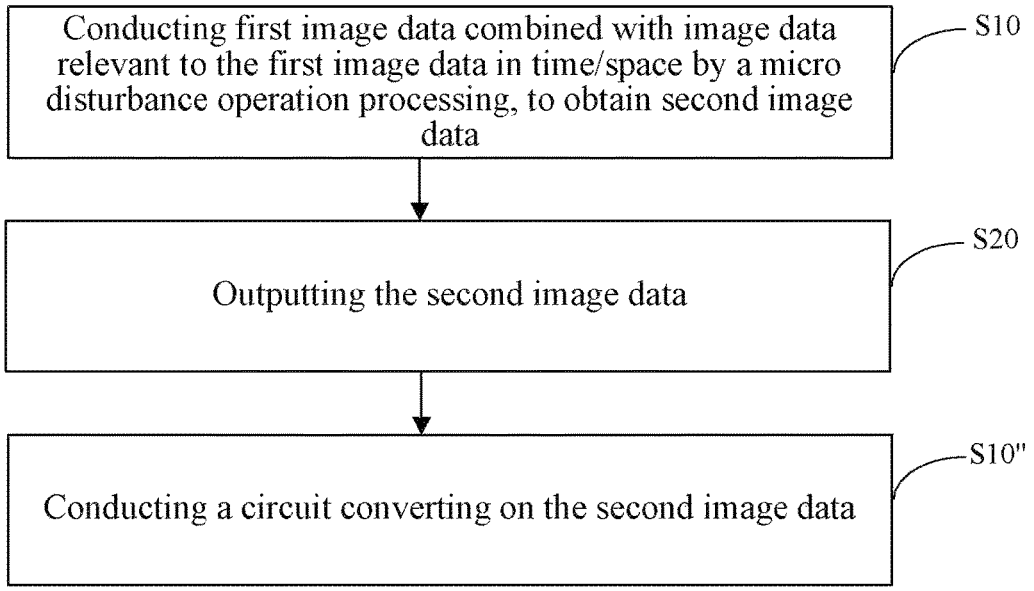
FIG. 4 is a flow chart of an implementation of a method provided according to another embodiment of the present disclosure.
Figure 5:
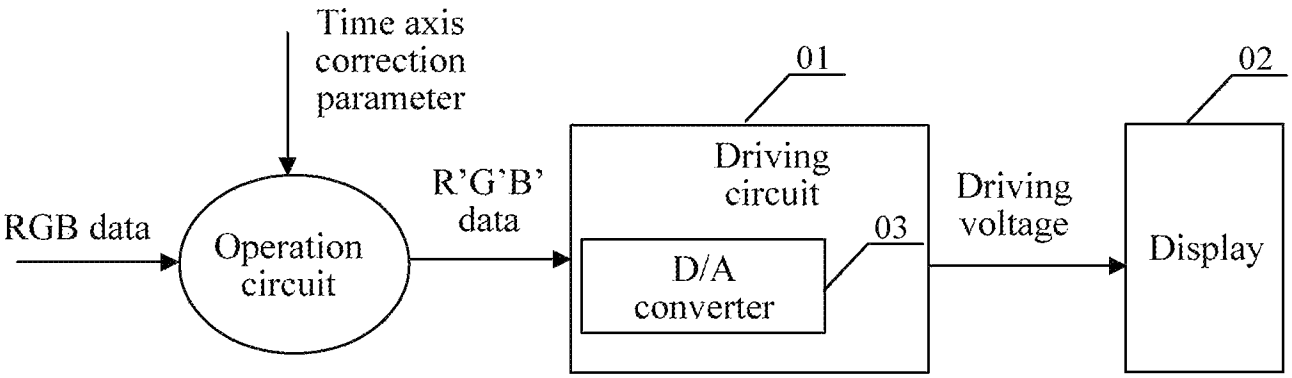
FIG. 5 is a driving principle diagram provided according to an embodiment of the present disclosure.

FIG. 3 and FIG. 4 respectively show flow charts of steps of the above two methods. In the present embodiment, taking a flow of FIG. 4 as an example, a circuit converting manner may be a digital-to-analogue conversion. That is to say, the digital-to-analogue conversion is conducted on the R'G'B' data input to the driving circuit. The driving principle is shown as FIG. 5. Assuming that the R'G'B' data is represented by R'G'B'_Data [7:0], after a digital-to-analogue conversion of 256:1, 256 channels of data V0, V1, V2 . . . V254 and V255 are converted into one channel of a driving voltage, represented by V_ R'G'B'. At last, color gray scales of respective sub-pixels on the display are determined based on the driving voltage. Fine tuning of colors is important to achieve full color display, and a gamma correction may be needed to change the gray scale, so as to improve color display effect.

Figure 6:
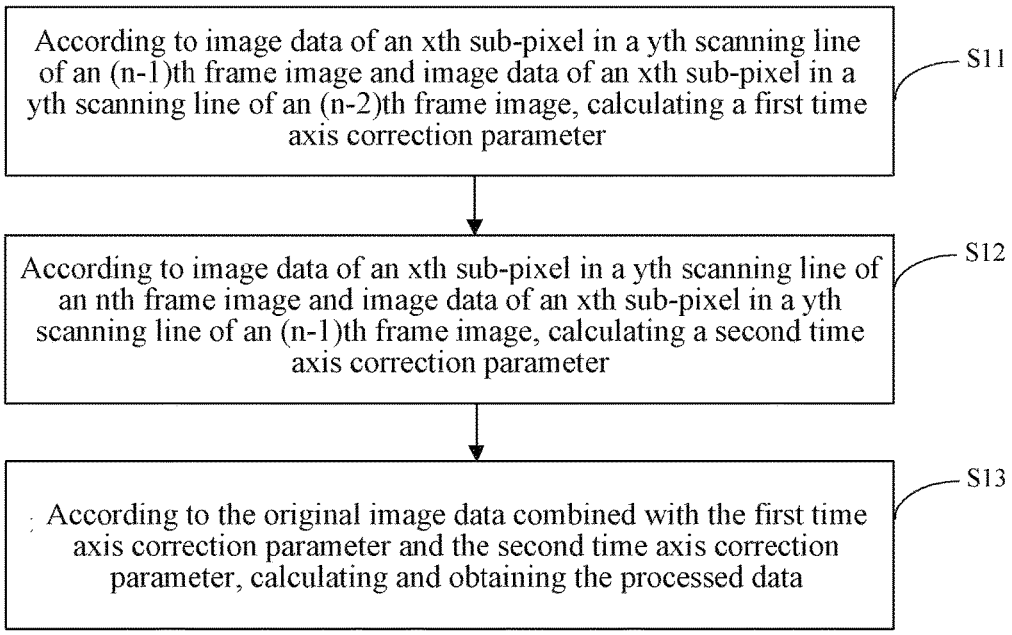
FIG. 6 is a flow chart of steps in step S10 according to an embodiment of the present disclosure.

FIG. 6 is a flow chart of steps that conduct dynamic micro disturbance operation processing on the first image data of each of the input sub-pixels according to time axis correction parameters in step S10 according to the present embodiment.

As shown in FIG. 6, in step S11, according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, a first time axis correction parameter is calculated. If an $x^{th}$ red sub-pixel in a $y^{th}$ scanning line of an $n^{th}$ frame image (i.e., the current frame) is taken as an example, a formula for calculating the first time axis correction parameter is:

$$\delta_1(R)=(R_{n-1}(x,y)-R_{n-2}(x,y))/R_{n-2}(x,y),$$

wherein $\delta_1(R)$ is the first time axis correction parameter of the red sub-pixel, $R_{n-1}(x, y)$ is the image data of the $x^{th}$ sub-pixel in the $y^{th}$ scanning line of the $(n-1)^{th}$ frame image, and $R_{n-2}(x, y)$ is the image data of the $x^{th}$ sub-pixel in the $y^{th}$ scanning line of the $(n-2)^{th}$ frame image.

As shown in FIG. 6, in step S12, according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, a second time axis correction parameter is calculated, and a formula for calculating the second time axis correction parameter is:

$$\delta_2(R)=(R_n(x,y)-R_{n-1}(x,y))/R_{n-1}(x,y),$$

wherein $\delta_2(R)$ is the second time axis correction parameter of the red sub-pixel, and $R_n(x, y)$ is the image data of the $x^{th}$ sub-pixel in the $y^{th}$ scanning line of the $n^{th}$ frame image.

As shown in FIG. 6, in step S13, according to the first image data combined with the first time axis correction parameter and the second time axis correction parameter, the second image data is calculated and obtained, and a calculating formula is:

$$R_n'(x,y)=R_n(x,y)+\omega_{n-2}*\delta_1(R)+\omega_{n-1}*\delta_2(R).$$

wherein $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1 which are set as needed.

The weight coefficients $\omega_{n-1}$ and $\omega_{n-2}$ may be set according to following manners:

taking 8-bit (256 gray scales) as an example, $\omega_{n-1}$ and $CO_{n-2}$ equal to q/256, q being 0~255;

taking 10-bit (1024 gray scales) as an example, $\omega_{n-1}$ and $\omega_{n-2}$ equal to q/1024, q being 0~1023. The weight coefficients may be determined according to the amount of gray scales in practical applications.

The calculating processes in the above steps S11-S13 all take a red sub-pixel as an example. Similarly, for sub-pixels with other colors, for example, a blue sub-pixel, a green sub-pixel or a white sub-pixel (if any), the calculating methods are as the above, which will not be repeatedly illustrated herein.

It shall be further noted that, "relevant image data" in the above embodiment means image data of a sub-pixel in the $(n-1)^{th}$ frame and the $(n-2)^{th}$ frame, which participate the calculations adopting the above method and formula, so as to realize adding a micro disturbance variable with respect to the time axis, to obtain the second image data. In other embodiments of the present disclosure, "relevant image data" may further mean image data of the $(n-1)^{th}$ frame, the $(n-2)^{th}$ frame, the $(n-3)^{th}$ frame and more frames, and there may be more corresponding time correction parameters, besides the above first time correction parameter and second time correction parameter.

Besides using image data of a frame preceding the current frame (i.e. a previous one frame or previous two frames), image data that has been cached and is of a frame after the current frame to be displayed (i.e. a next one frame or next two frames) may also be used, the principle and calculating manner of which are similar, and will not be illustrated herein. In practical applications, appropriate relevant data may be chosen to conduct correction operations according to need and advantages and disadvantages of different correction manners. For example, if the second image data is generated by referring to "a previous one frame" and "a next one frame" at the same time, the display effect will be better, but caching cost is high. If the second image data is generated only by referring to "a previous one frame", the display effect will be also optimized, and not better than the former, but the caching cost may be reduced. If the second image data is generated by referring to "a next one frame", the display effect will be also optimized, but calculating control is complex and the caching cost is high.

It shall be noted that, the method provided by the present embodiment may further conduct a micro disturbance variable with respect to the space axis, besides conducting a micro disturbance variable with respect to the time axis. That is, the method may dynamically conduct a micro disturbance operation processing on the first image data of each of the input sub-pixels according to a time axis correction parameter and a space axis correction parameter.

In the present embodiment, a concept of the space axis means a resolution ratio of the display. Taking a resolution ratio of 1920×1080 as an example, there are 1920 pixels (RGB) in the horizontal axis and there are 1080 scanning lines in the vertical axis. Conducting space axis micro disturbance means to provide appropriate micro disturbance data variation with respect to different scanning lines or different pixel addresses. If the time axis micro disturbance and the space axis micro disturbance are applied at the same time, the display effect will be better.

Therefore, the second image data obtained by the step S10 is the image data obtained by conducting a micro disturbance operation processing on the first image data according to the time axis correction parameter and the space axis correction parameter.

To sum up, advantageous effects of the present disclosure lie in that: by changing the conventional driving mechanism, adding time axis correction parameter which may be dynamically adjusted with respect to the time axis to the first image data and conducting the micro disturbance operation, color gray scales of respective sub-pixels on the display may be determined according to the adjusted driving circuit, which may make colors of image data on the display more plentiful and optimize display effect. Further, if the time axis micro disturbance and the space axis micro disturbance are applied at the same time, the display effect will be better.

Figure 7:
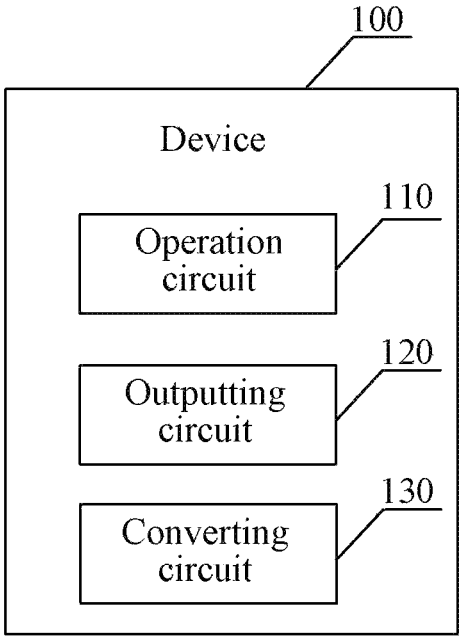
FIG. 7 is a schematic diagram of a device of driving a display provided according to an embodiment of the present disclosure.

FIG. 7 further shows a schematic diagram of a device of driving a display provided according to an embodiment of the present disclosure. The device 100 is configured to optimize color display effect of the display. As shown in FIG. 7, the device 100 includes: an operation circuit 110, an outputting circuit 120 and a converting circuit 130. The operation circuit 110 for example may be a digital signal processing circuit, which may be realized through Verilog (a kind of hardware descriptive language) coding with a FPGA (Field Programmable Gate Array), or through a micro-processor with software, mainly to realize the function for calculating digital signals. The outputting circuit 120 for example may also be a digital signal processing circuit, which may also be realized through Verilog coding with a FPGA, or through a micro-processor with software, mainly for outputting the result of the operation circuit 110 in an appropriate sequence and scan timing. The converting circuit 130 may be a D/A converter, mainly for converting digital signals into driving voltages.

In the present embodiment, the operation circuit 110 is configured to, conduct first image data combined with image data relevant to the first image data in time/space by a micro disturbance operation processing, to obtain second image data. The outputting circuit 120 is configured to output the second image data. The converting circuit 130 is configured to conduct a circuit converting on the first image data or the second image data, to obtain a corresponding driving voltage, so as to determine color gray scales of respective sub-pixels on the display based on the driving voltage.

Figure 8:
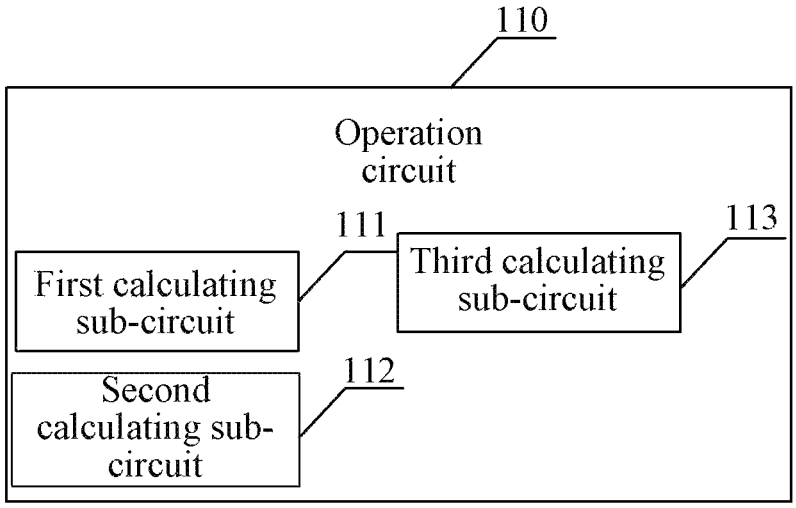
FIG. 8 is a schematic diagram of an operation circuit provided according to an embodiment of the present disclosure.

In the present embodiment, assuming that image data of an $x^{th}$ sub-pixel in a $y^{th}$ scanning line of an $n^{th}$ frame image is the first image data, FIG. 8 shows a schematic diagram of the operation circuit 110. As shown in FIG. 8, the operation circuit 110 includes: a first calculating sub-circuit 111, a second calculating sub-circuit 112 and a third calculating sub-circuit 113. The first calculating sub-circuit 111 for example may be a digital signal processing circuit, which may be realized through Verilog coding with a FPGA, or through a micro-processor with software, mainly to realize the function for calculating digital signals, to generate a time axis parameter. The second calculating sub-circuit 112 for example may also be a digital signal processing circuit, which may be realized through Verilog coding with a FPGA, or through a micro-processor with software, mainly to realize the function for calculating digital signals, to generate a spatial axis parameter. The third calculating sub-circuit 113 for example may also be a digital signal processing circuit, which may be realized through Verilog coding with a FPGA, or through a micro-processor with software, mainly to calculate and generate new image data, based on the time axis parameter, the spatial axis parameter and the original image data.

The first calculating sub-circuit 111 is configured to, according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, calculate first time axis correction parameter. If an $x^{th}$ red sub-pixel in a $y^{th}$ scanning line of an $n^{th}$ frame image (i.e., the current frame) is taken as an example, a formula for calculating the first time axis correction parameter is:

$$\delta_1(R)=(R_{n-1}(x,y)-R_{n-2}(x,y))/R_{n-2}(x,y),$$

the second calculating sub-circuit 112 is configured to, according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, calculate second time axis correction parameter, and a formula is:

$$\delta_2(R)=(R_n(x,y)-R_{n-1}(x,y))/R_{n-1}(x,y),$$

the third calculating sub-circuit 113 is configured to, according to the first image data combined with the first time axis correction parameter and the second time axis correction parameter, to calculate and obtain the second image data, and a formula is:

$$R_n'(x,y)=R_n(x,y)+\omega_{n-2}*\delta_1(R)+\omega_{n-1}*\delta_2(R)$$

wherein $\delta_1(R)$ is the first time axis correction parameter of the red sub-pixel, $\delta_2(R)$ is the second time axis correction parameter of the red sub-pixel, $R_n(x, y)$ is the image data of the $x^{th}$ sub-pixel in the $y^{th}$ scanning line of the $n^{th}$ frame image, $R_{n-1}(x, y)$ is the image data of the $x^{th}$ sub-pixel in the $y^{th}$ scanning line of the $(n-1)^{th}$ frame image, $R_{n-2}(x, y)$ is the image data of the $x^{th}$ sub-pixel in the $y^{th}$ scanning line of the $(n-2)^{th}$ frame image, $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1.

In addition to the above, the operation circuit 110 in the present embodiment may further conduct a micro disturbance adjustment according to a space axis correction parameter. The image data is passed to the operation circuit 110 according to an external image signal source. Appropriate micro data variation may be provided with respect to different scanning lines or different pixel addresses, according to timing sequence information of the transmission of external images. If the time axis micro disturbance and the space axis micro disturbance are applied at the same time, the display effect will be better.

To sum up, advantageous effects of the device of the present disclosure lie in that: by adding an operation circuit to change the conventional driving mechanism, adding a time axis correction parameter which may be dynamically adjusted with respect to the time axis to the first image data and conducting the micro disturbance operation, so as to determine color gray scales of respective sub-pixels on the display according to the adjusted driving circuit, which may make colors of image data on the display more plentiful and optimize display effect.

Figure 9:
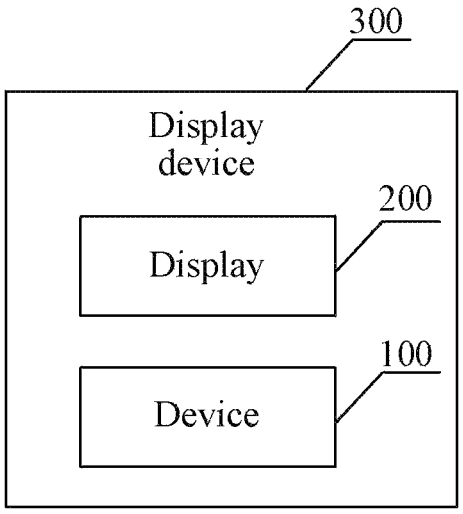
FIG. 9 is a schematic diagram of a display device provided according to an embodiment of the present disclosure.

Based on the above, the present embodiment further provides a display device. As shown in FIG. 9, the display device 300 includes a display 200 and the device 100 of driving the display 200, and adopts the above method, which may make colors of the image data on the display more plentiful and optimize display effect.

Those skilled in the art shall note that changes and modifications without departing from the scope and spirit of the present disclosure disclosed by the appended claims all belong to the protection scope of claims of the present disclosure.

What is claimed is:

1. A method of driving a display, comprising:

conducting first image data combined with image data relevant to the first image data in time/space by a micro disturbance operation processing, to obtain second image data; and outputting the second image data, wherein the image data relevant to the first image data in time/space is image data of two frames preceding the first image data, and wherein the conducting first image data combined with image data relevant to the first image data in time/space by a micro disturbance operation processing comprises:

according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, calculating a first time axis correction parameter;

according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, calculating a second time axis correction parameter; and according to the first image data combined with the first time axis correction parameter and the second time axis correction parameter, calculating and obtaining the second image data, wherein the image data of the $x^{th}$ sub-pixel in the $y^{th}$ scanning line of the $n^{th}$ frame image is the first image data.

2. The method according to claim 1, further comprising:

conducting a circuit converting on the first image data or the second image data, to obtain a corresponding driving voltage.

3. The method according to claim 1, wherein a formula for calculating the first time axis correction parameter is:

$$\delta_1(R)=(R_{n-1}(x,y)-R_{n-2}(x,y))/R_{n-2}(x,y),$$

a formula for calculating the second time axis correction parameter is:

$$\delta_2(R)=(R_n(x,y)-R_{n-1}(x,y))/R_{n-1}(x,y), \text{ and}$$

a formula for calculating the second image data is:

$$R_n'(x,y)=R_n(x,y)+\omega_{n-2}*\delta_1(R)+\omega_{n-1}*\delta_2(R),$$

wherein $\delta_1(R)$ is the first time axis correction parameter of the $x^{th}$ sub-pixel in the $y^{th}$ scanning line of the $n^{th}$ frame image, $\delta_2(R)$ is the second time axis correction parameter of the $x^{th}$ sub-pixel in the $y^{th}$ scanning line of the $n^{th}$ frame image, $R_n(x, y)$ is the image data of the $x^{th}$ sub-pixel in the $y^{th}$ scanning line of the $n^{th}$ frame image, $R_{n-1}(x, y)$ is the image data of the $x^{th}$ sub-pixel in the $y^{th}$ scanning line of the $(n-1)^{th}$ frame image, $R_{n-2}(x, y)$ is the image data of the $x^{th}$ sub-pixel in the $y^{th}$ scanning line of the $(n-2)^{th}$ frame image, $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1.

4. A device of driving a display, comprising:

an operation circuit, configured to conduct first image data combined with image data relevant to the first image data in time/space by a micro disturbance operation processing to obtain second image data; and an outputting circuit, configured to output the second image data, wherein the image data relevant to the first image data in time/space is image data of two frames preceding the first image data, and wherein the operation circuit comprises, as the micro disturbance operation processing;

a first calculating sub-circuit, configured to, according to image data of an $x^{th}$ sub-pixel in a $y^{th}$ scanning line of an $(n-1)^{th}$ frame image and image data of an $x^{th}$ sub-pixel in a $y^{th}$ scanning line of an $(n-2)^{th}$ frame image, calculate a first time axis correction parameter;

a second calculating sub-circuit, configured to, according to image data of an $x^{th}$ sub-pixel in a $y^{th}$ scanning line of an $n^{th}$ frame image and image data of an $x^{th}$ sub-pixel in a $y^{th}$ scanning line of an $(n-1)^{th}$ frame image, calculate a second time axis correction parameter, and a third calculating sub-circuit, configured to, according to the first image data combined with the first time axis correction parameter and the second time axis correction parameter, to calculate and obtain the second image data, wherein the image data of the $x^{th}$ sub-pixel in the $y^{th}$ scanning line of the $n^{th}$ frame image is the first image data.

5. The device according to claim 4, further comprising:

a converting circuit, configured to conduct a circuit converting on the first image data or the second image data, to obtain a corresponding driving voltage.

6. The device according to claim 4, wherein a formula by which the first calculating sub-circuit calculates the first time axis correction parameter is:

$$\delta_1(R)=(R_{n-1}(x,y)-R_{n-2}(x,y))/R_{n-2}(x,y),$$

a formula by which the second calculating sub-circuit calculates the second time axis correction parameter is:

$$\delta_2(R)=(R_n(x,y)-R_{n-1}(x,y))/R_{n-1}(x,y), \text{ and}$$

a formula by which the third calculating sub-circuit calculates the second image data is:

$$R_n'(x,y)=R_n(x,y)+\omega_{n-2}*\delta_1(R)+\omega_{n-1}*\delta_2(R),$$

wherein $\delta_1(R)$ is the first time axis correction parameter of the $x^{th}$ sub-pixel in the $y^{th}$ scanning line of the $n^{th}$ frame image, $\delta_2(R)$ is the second time axis correction parameter of the $x^{th}$ sub-pixel in the $y^{th}$ scanning line of the $n^{th}$ frame image, $R_n(x, y)$ is the image data of the $x^{th}$ sub-pixel in the $y^{th}$ scanning line of the $n^{th}$ frame image, $R_{n-1}(x, y)$ is the image data of the $x^{th}$ sub-pixel in the $y^{th}$ scanning line of the $(n-1)^{th}$ frame image, $R_{n-2}(x, y)$ is the image data of the $x^{th}$ sub-pixel in the $y^{th}$ scanning line of the $(n-2)^{th}$ frame image, $R_n'(x, y)$ is the second image data after conducting the micro disturbance operation processing on the image data of the $x^{th}$ sub-pixel in the $y^{th}$ scanning line of the $n^{th}$ frame image, and $\omega_{n-1}$ and $\omega_{n-2}$ are both weight coefficients with a numerical range of 0~1.

7. A display device, comprising a display and the device of driving the display according to claim 4.

* * * * *